US005178269A

United States Patent [19]

Evers

[11] Patent Number: 5,178,269

[45] Date of Patent: Jan. 12, 1993

[54] TAX-STAMPABLE HALF-CARTON

[75] Inventor: Donald H. Evers, Richmond, Va.

[73] Assignee: Philip Morris Inc., New York, N.Y.

[21] Appl. No.: 822,588

[22] Filed: Jan. 17, 1992

[51] Int. Cl.[5] ..... B65D 85/10; B65D 5/54

[52] U.S. Cl. ..... 206/256; 206/813; 206/273; 229/120.011

[58] Field of Search ..... 206/813, 273, 271, 256; 229/120.09, 120.011

[56] References Cited

U.S. PATENT DOCUMENTS 2,771,234 3/1952 Hultin .
3,809,227 5/1974 Begemann .
4,631,900 12/1986 Mattei et al. ..... 229/120.011
4,669,611 6/1987 Flaherty .
4,738,359 4/1988 Phillips, Jr. .
4,928,817 5/1990 Focke .
4,932,534 6/1990 Focke et al. ..... 229/120.09

*Primary Examiner*—William I. Price
*Attorney, Agent, or Firm*—Jeffrey M. Hersh

[57] ABSTRACT

A cigarette carton comprising two half-cartons, each containing five cigarette packs, which may be sold as one standard 10-pack cigarette carton or may be separated and sold as individual half-cartons. The dual half-carton configuration permits the use of existing tax-stamping machines without significant modifications. Each half-carton is formed from a single blank and has a perforated extension tab extending from one side wall, and a top closure. Two half-cartons are joined together by positioning the walls from which the top closures are foldably attached remote from each other and by gluing each extension tab to the side wall of the other half-carton.

25 Claims, 7 Drawing Sheets

TAX-STAMPABLE HALF-CARTON

BACKGROUND OF THE INVENTION

This invention relates to cigarette packages. More particularly, this invention relates to detachable paperboard double half-cartons for cigarette packs in which two attached half-cartons are run through a standard tax-stamping machine and then may be separated for sale as separate, individual half-carton units.

Cigarettes are commonly sold in paperboard cartons of ten cigarette packs, each pack containing about twenty to twenty-five cigarettes. Due to the rising cost of standard cigarette cartons it has become desirable to make available to consumers half-cartons of five cigarette packs in addition to the standard 10-pack cartons.

Standard cigarette cartons contain two parallel rows of five packs in which the packs in each row are aligned side-by-side. In each row, the packs typically are positioned with the bottom of the pack facing upward and the sides adjacent to and touching each other.

Most states and some cities require that tax stamps be affixed to cigarette packs prior to sale. Because of this requirement, cigarette cartons are made without permanently sealing the lids of the cartons, so that they may be opened, run through a tax-stamping machine, reclosed, then shipped to retail stores for sale to consumers. Existing tax-stamping machines are geared for simultaneously stamping 10 cigarette packages in the standard 2×5-pack configuration. Accordingly, to use existing tax-stamping machines, half-cartons must be configured in parallel pairs such that two half-cartons may be sent through a standard tax-stamping machine in one 2×5-pack unit. However, the two half-cartons must be held together securely, without slipping, to ensure that the tax-stamping machine will function correctly. In addition, the two half-cartons must not be too thick to pass between the vertical rollers of the tax-stamping machine.

It would be desirable to be able to provide a half-carton for cigarette packs, of which two half-cartons can be temporarily attached for running through a tax-stamping machine without developing new technology or expensive retooling and modifications of existing carton fabrication machines and procedures.

SUMMARY OF THE INVENTION

It is an object of this invention to provide an improved way of packaging cigarette packs into detachable half-cartons for use in existing taxstamping machines and with minimal modifications to carton-fabrication machines and procedures.

It is another object of the present invention to make each half-carton from a single modified blank, preferably of paperboard. This has the advantage that only one half-carton design is required.

The blank is folded around a designated quantity of cigarette packs, preferably five, to form a half-carton with an interior wall, an exterior wall, a bottom wall, a first side wall, a second side wall containing a detachable extension tab, and a top closure. The top closure is attached horizontally to and at the top of the exterior wall. The detachable extension tab is attached vertically and centered along the edge of the side wall that is connected to the vertical edge of the interior wall. The extension tab will preferably be perforated along the edge connecting it to the side wall, and preferably will be semi-circular in shape with a radius of curvature less than the width of the side wall. However, many other shapes and sizes are possible for the extension tab.

During assembly, one half-carton is rotated 180° and attached to a second half-carton by abutting the interior walls of the half-cartons against each other and securing the extension tab on each half-carton to the first side wall of the other half-carton. The extension tabs may be secured with glue, tape or other adhesive.

Another object of the present invention is to provide a modified top closure that may be folded back to permit tax-stamping on existing equipment then later tucked into each half-carton. In this way, the double half-carton unit may be separated into two distinct, fully enclosed half-carton units of five cigarette packs for retail sale to consumers. Alternately, the half-cartons may be separated after tax stamping and the top closure of each folded over and secured to the outside of the interior wall of the half-carton.

During the initial assembly process, after the two half-cartons are attached to form one 2×5-pack unit, the top closures are temporarily closed by folding one top closure over the top of both half-cartons, then folding the other top closure over the top of the first one. The top closures may be secured closed by a releasable glue, tape or other adhesive. The double half-carton unit is then ready for shipping and later tax stamping.

Immediately prior to tax stamping, the temporarily closed top closures are opened and folded back to expose the bottoms of the cigarette packs. Each pack is then stamped. Once stamped, the top closures may be closed by tucking the tuck portion inside the half-carton along the top of the interior side of the interior wall. Alternatively, the top closure may be secured by gluing the tuck portion to the exterior side of the top portion of the interior wall.

It is a further object of the present invention to ship such enclosed double half-cartons to retailers for sale to consumers either in a double half-carton unit, or by breaking the perforated edges of the extension tabs and thereby separating it into two half-carton units. The cigarette packs in each half-carton are preferably positioned such that the label or logo on the bottom of the packs may be read by a consumer who opens the top closure with the interior wall of the half-carton facing the consumer.

BRIEF DESCRIPTION OF THE DRAWINGS

The above and other objects and advantages of the present invention will be apparent upon consideration of the following detailed descriptions, taken in conjunction with the accompanying drawings, in which the reference characters refer to the parts throughout and in which.

DETAILED DESCRIPTION OF THE INVENTION

Figure 1:
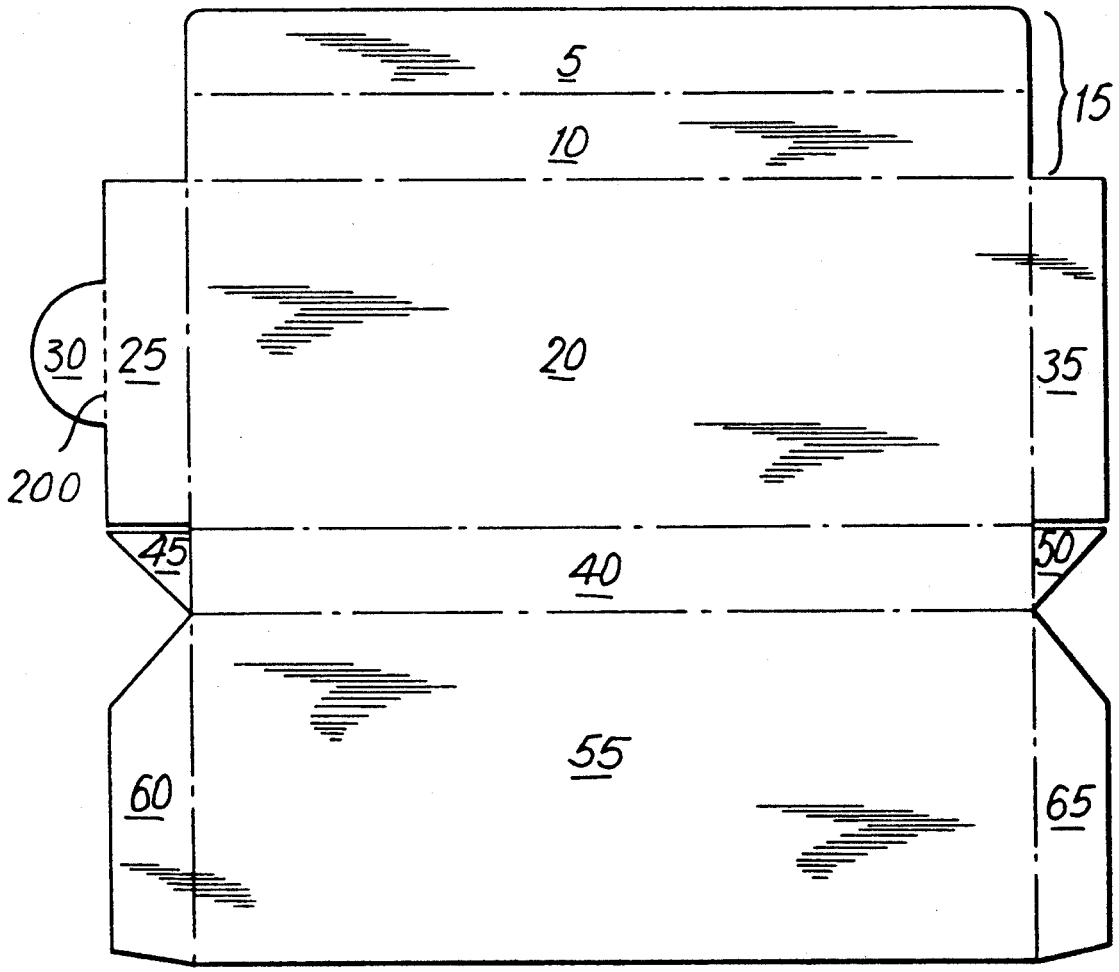
FIG. 1 shows a single blank of paperboard that when folded forms a half-carton.

In the preferred embodiment of the present invention, a blank of paperboard is fabricated as shown in FIG. 1, which will ultimately form one half-carton. The dashed lines containing alternating long and short dashes are fold lines or perforated scores along which the walls of the half-carton are folded to form the half-carton configuration. Dashed line 200, which separates side wall 25 and extension tab 30, is perforated to allow for later separation of the extension tab and the two half-cartons.

The blank is folded along the fold lines or perforated scores to encase five cigarette packs aligned side-by-side. The top of the cigarette packs will rest along bottom wall 40. Interior wall 55 is folded up such that it rests against the interior walls of the five cigarette packs. Dust flaps 45 and 50 and box insert side walls 60 and 65 are folded up to rest along the side walls of the two cigarette pack positioned farthest from each other. Exterior wall 20 is then folded up to rest against the exterior walls of the five cigarette packs, and side walls 25 and 35 are folded in and glued to box insert side walls 60 and 65, respectively.

The extension tab 30 is preferably semi-circular in shape and has a radius of curvature that is less than the width of side wall 35, that is, less than the shortest distance between exterior wall 20 and interior wall 55 when the half-carton is assembled. Of course, any shape of extension tab may be provided, so long as it does not extend out more than the width of side wall 35.

Those skilled in the art will understand that the half-carton does not need to be formed around five cigarette packs but instead may be formed hollow, so that the cigarette packs may later be inserted into the half-carton.

The cigarette packs are preferably positioned in each half-carton with the bottom of the pack next to the top closure and with the logo or brand name readable when the top closure is opened away from the consumer. In other words, the bottom of the logo or brand name on the exposed side of the cigarette pack is adjacent to the interior wall and the top is adjacent to the exterior wall.

In addition, those skilled in the art will recognize that the blank may be folded into a half-carton in any position. For example, the blank may be folded with bottom wall 40 positioned vertically.

Finally, those skilled in the art will appreciate that many types of glue, tape or adhesive may be used to attached side walls 25 and 35 to box insert side walls 60 and 65, respectively, and extension tab 30 may be detachably attached to side wall 25 by other means than perforation line 200. Also, many shapes and sizes of box insert side walls 60 and 65 may be used, and dust flaps 45 and 50 may also be of any size, or omitted altogether. However, the preferred embodiment includes dust flaps and uses large box insert side walls to provide greater stability to the half-carton.

Figure 2:
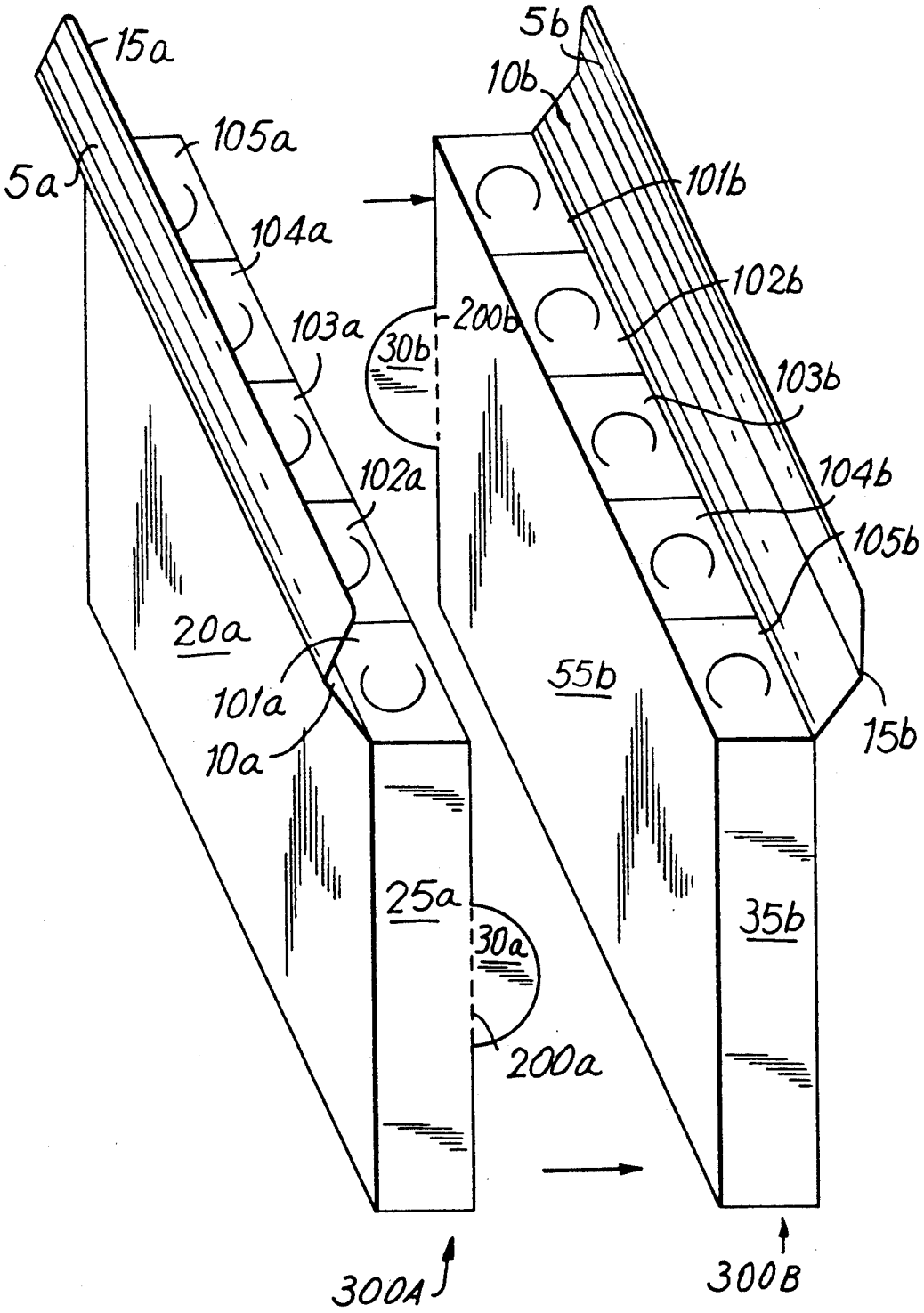
FIG. 2 shows two assembled half-cartons positioned in parallel for attachment.

FIG. 2 shows two assembled half-cartons, labeled 300A and 300B, positioned for attachment. Each half-carton contains five cigarette packs 101–105, the numbers in incremental order starting at side wall 25 and ending at side wall 35. The cigarette packs in half-carton 300A are labeled **101*a*–105*a*, and those in half-carton 300B are labeled 101*b*–105*b*. This parallel numbering system—in which each part is designated with the number used in FIG. 1 followed by the letter "a" or "b" to indicate the half-carton being referred to—is used throughout FIGS. 2–7**.

One half-carton has been rotated 180° such that interior walls **55*a* and 55*b* face each other. This configuration allows extension tab 30*a* to be attached to side wall 35*b*, and extension tab 30*b* to be attached to side wall 35*a*. Top closures 15*a* and 15*b* are positioned opposite each other such that when the half-cartons are moved together, as shown by the two arrows in FIG. 2, and attached, the top closures are on opposite sides of the top of the double half-carton unit. This configuration is important so that the top closures may later be bent back to allow for tax stamping. Thus, it is important that extension tabs 30*a* and 30*b* extend from the side remote from the side to which top closures 15*a* and 15*b***, respectively, are hinged.

Figure 3:
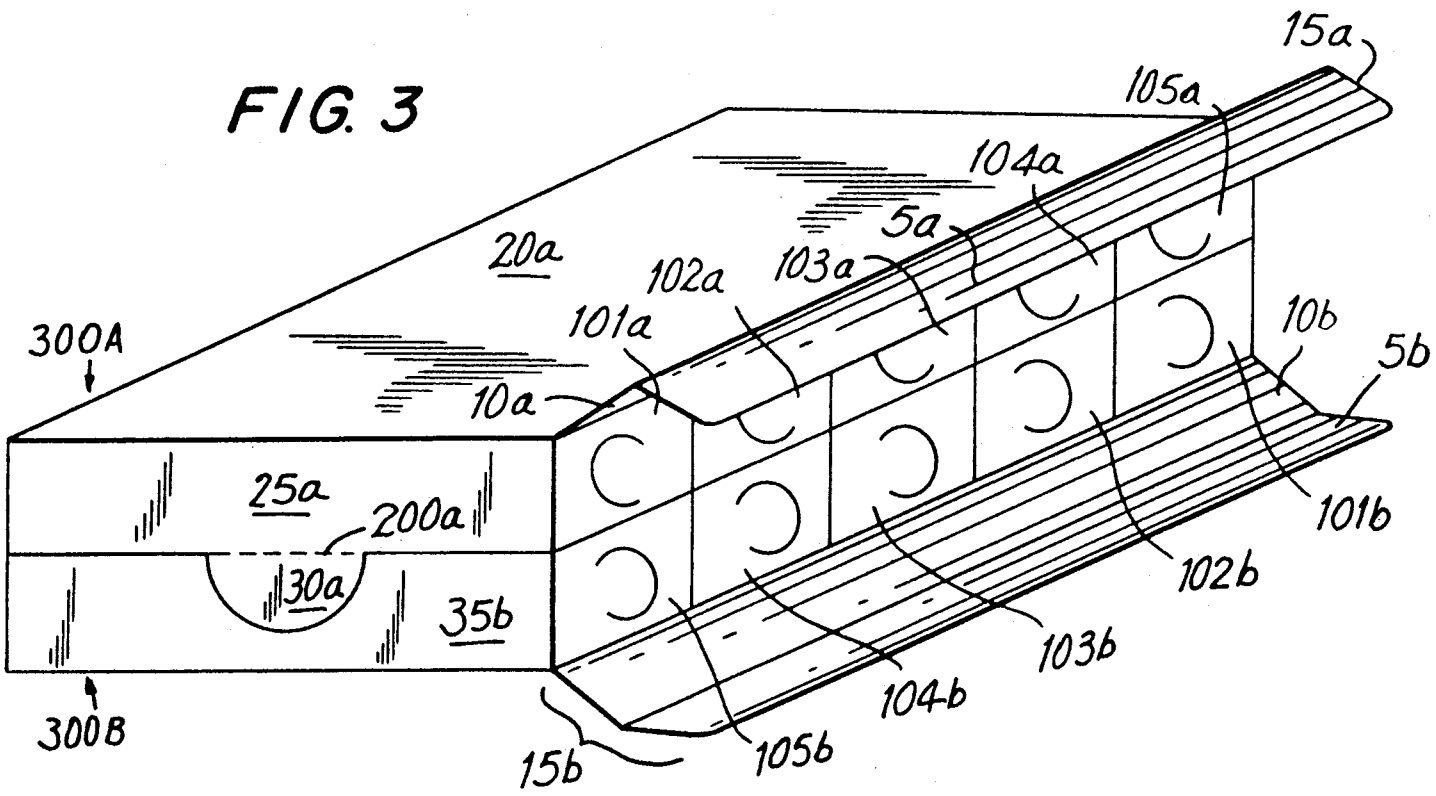
FIG. 3 shows the two half-cartons after being attached.

FIG. 3 shows the half-cartons of FIG. 2 attached to each other. In the preferred embodiment, extension tab **30*a* is secured to side wall 35*b* with glue; however, tape or any other adhesive may be used. On the opposite side of the double half-carton unit, which is not visible in FIG. 3, extension tab 30*b* is similarly glued or otherwise secured to side wall 35*a*. The glue, tape or other adhesive used must withstand greater force than that required to tear perforation lines 200*a* and 200*b***. It must also withstand the force of the tax-stamping machine.

Because one half-carton is rotated 180°, cigarette pack **101*a* is adjacent to cigarette pack 105*b*, cigarette pack 102*a* is adjacent to cigarette pack 104*b*, cigarette pack 103*a* is adjacent to cigarette pack 103*b*, cigarette pack 104*a* is adjacent to cigarette pack 102*b*, and cigarette pack 105*a* is adjacent to cigarette pack 101*b*, as shown in FIG. 3**.

The cigarette packs **101*a*–105*a* and 101*b*–105*b* are preferably positioned such that the brand name or logo is readable when top closure 15*a* or 15*b* is opened and pivoted away from the consumer. Thus, the orientation of the logos and brand names on the cigarette packs in one half-carton are inverted relative to the orientation of those in the adjoining half-carton. This orientation is illustrated by the letter "C" on each cigarette pack shown in FIGS. 2–3**.

When the half-cartons are attached, interior walls **55*a* and 55*b* abut against each other, forming a centerline that divides the two rows of cigarette packs. Exterior walls 20*a* and 20*b* form the exterior walls of the double half-carton unit. Perforation lines 200*a* and 200*b* form a vertical centerline between half-cartons 300A and 300B**, and function as the only direct connection between and attaching the half-cartons However, the half-cartons may be further secured by other detachable adhesive means at other locations.

Figure 4:
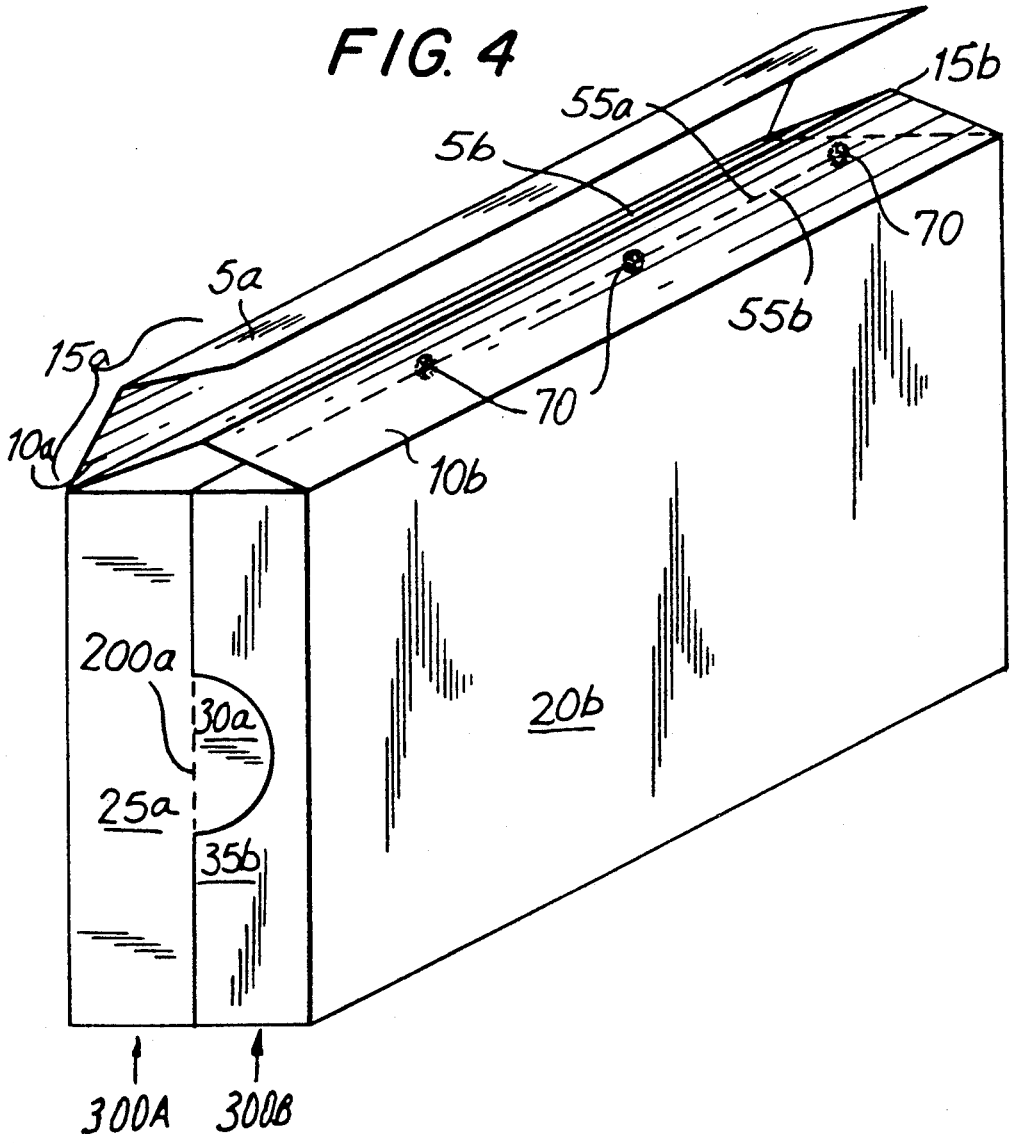
FIG. 4 shows the process of temporarily closing the top closures for shipment to be later reopened for tax stamping.
Figure 5:
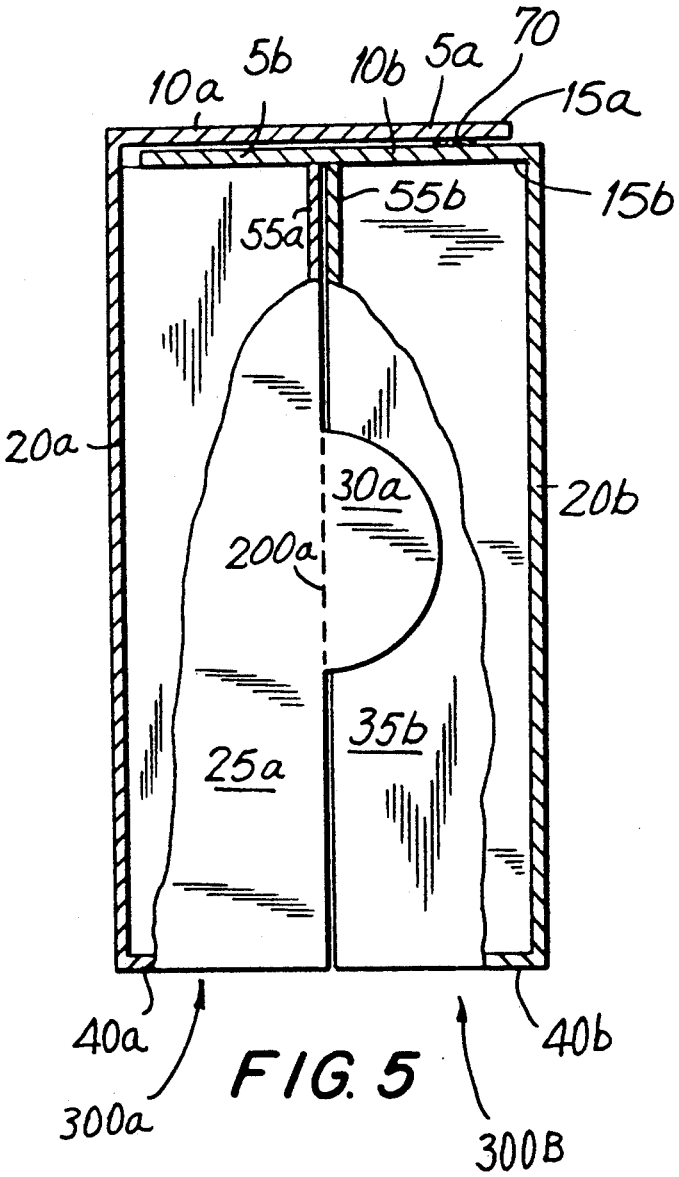
FIG. 5 is a side view of a double half-carton unit with the top closures in the temporarily closed position.

Top closures **15*a* and 15*b* are then temporarily closed, as shown in FIGS. 4–5. Top closure 15*b* is first folded across the open top of the two rows of cigarette packs. The tuck portion 5*b* of top closure 15*b* will lay on top of half-carton 300A in a non-tucked position, directly above cigarette packs 101*a*–105*a*. The top wall portion 10*b* of top closure 15*b* will lay on top of half-carton 300B, directly above cigarette packs 101*b*–105*b***.

Top closure **15*a* is then folded across the top of temporarily closed top closure 15*b*. When closed, tuck portion 5*a* of top closure 15*a* will lay directly on top of top wall portion 10*b* of top closure 15*b*, and top wall portion 10*a* of top closure 15*a* will lay directly on top of tuck portion 5*b* of top closure 15*b***.

Top closures 15*a* and 15*b* are preferably secured by glue points 70 that are strong enough to keep the unit closed during shipment, but weak enough to be torn open without significantly damaging the paperboard on the top closures. The glue may be placed at one or more places along top wall 10*b*. Three equal spaced glue points 70 are shown in FIG. 4.

Alternately, one or more glue points may be applied to the bottom of tuck portion 5*a*. In either case, the glue will temporarily affix top wall 10*b* to tuck portion 5*a* as shown by glue point 70 in FIG. 5.

Tape or another adhesive may be used instead of glue, and the glue or other adhesive means may be located at other positions on the dual half-carton configuration. Such adhesive means are common in the industry and obvious to implement by one ordinarily skilled in the art.

Alternately, top closure 15*a* may be closed before tuck flap 15*b*. Because the half-cartons are identical, the double half-carton unit has rotational symmetry along the vertical major axis positioned between and at the center of interior walls 55*a* and 55*b*. Thus, regardless of which top closure is closed first, the temporarily closed, double half-carton is the same.

The temporarily closed, double half-carton unit is then shipped either directly or indirectly via a warehouse to a tax-stamping facility. Once there, the temporarily closed top closures 15*a* and 15*b* are opened, using machinery and techniques that will be obvious to those skilled in the art. Once opened, the double half-carton unit will be the same as it was prior to closing the top closures, as shown in FIG. 3.

Figure 6:
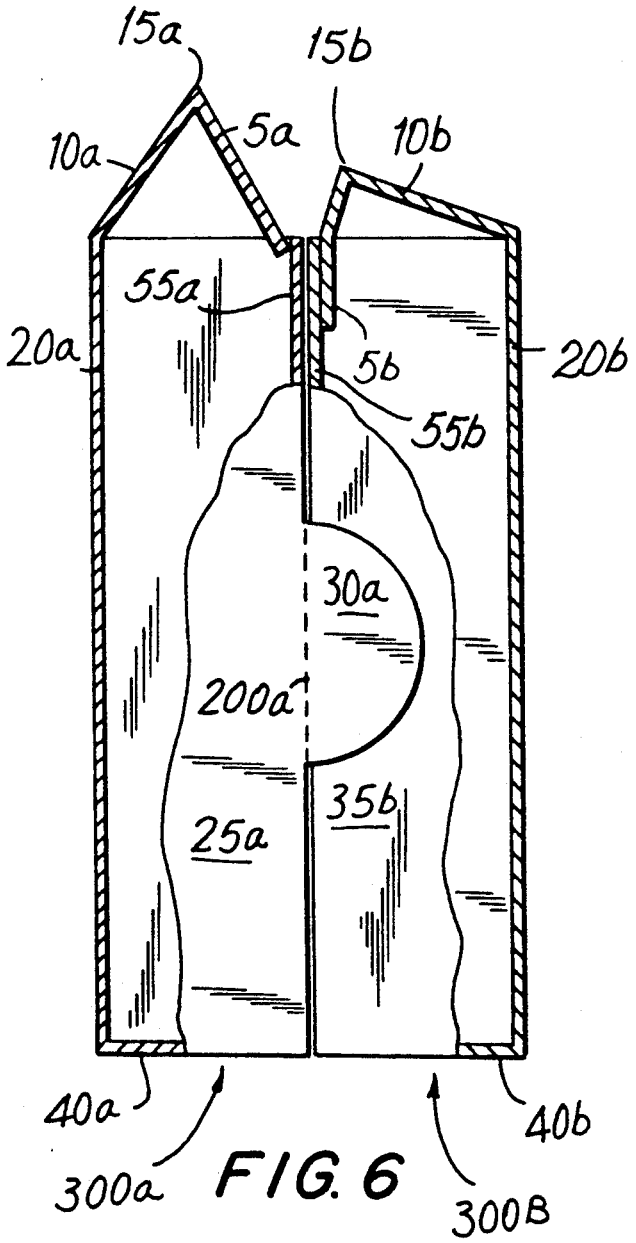
FIG. 6 is a side view showing the top closures of the double half-carton unit being tucked into each half-carton after having been tax stamped.

Top closures 15*a* and 15*b* are then folded back along exterior walls 20*a* and 20*b*, respectively, and run through an existing tax-stamping machine. Top closures 15*a* and 15*b* are then tucked into each respective half-carton as shown in FIG. 6. Tuck portion 5*a* of top closure 15*a* is inserted between the cigarette packs 101*a*–105*a* and the inside of interior wall 55*a*. Top portion 10*a* of tuck flap 15*a* forms the top wall of half-carton 300A.

Similarly, tuck portion 5*b* is inserted between cigarette packs 101*b*–105*b* and interior wall 55*b*, and top portion 10*b* forms the top wall of half-carton 300B.

The closed, double half-carton unit is then ready for final shipment to retailers for sale to consumers. A retailer may sell the double half-carton unit as one carton of ten cigarette packs, or the retailer may separate and sell individual half-cartons of five cigarette packs.

Figure 7:
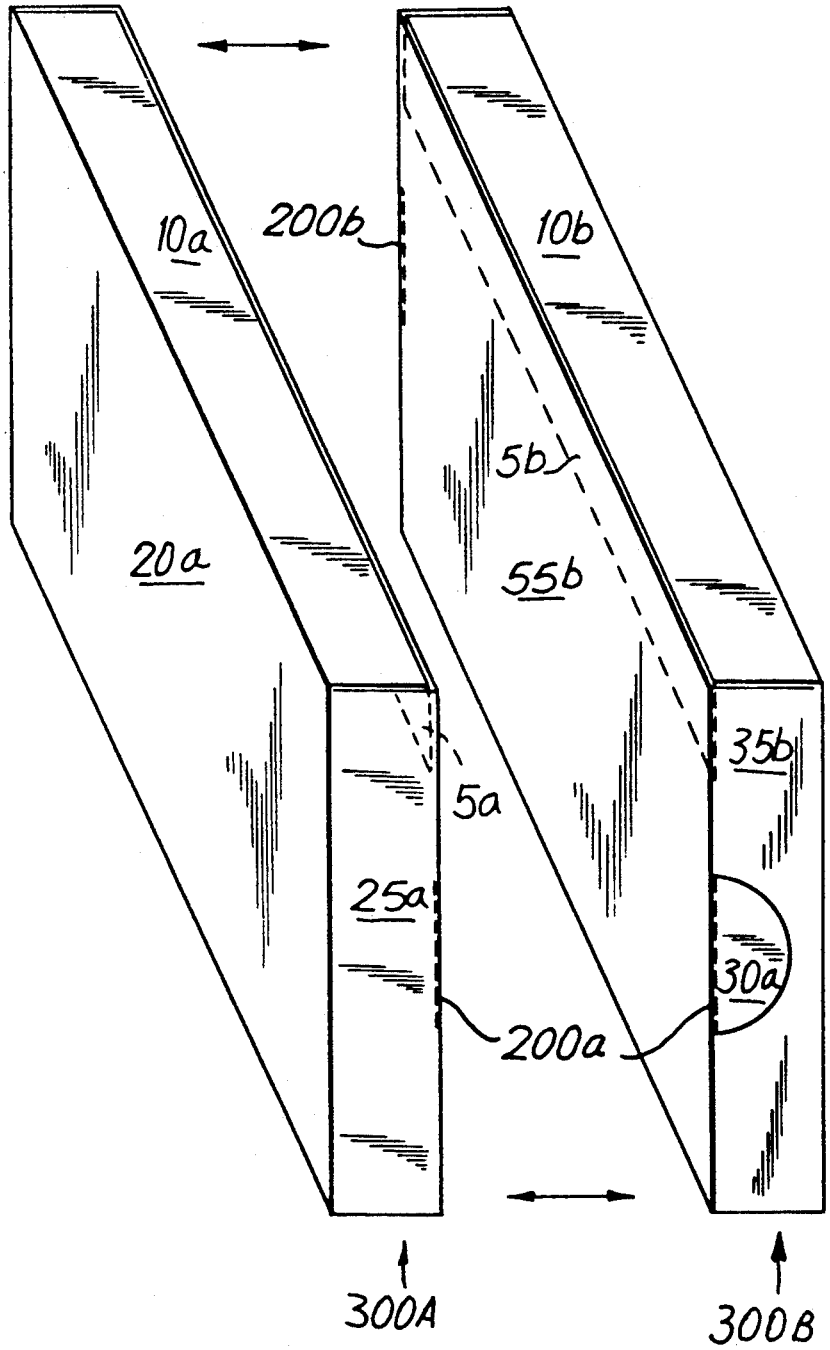
FIG. 7 shows the double half-carton unit after separation into two fully enclosed half-cartons of five cigarette packs.

The double half-carton unit may be separated by applying force to each half-carton in the direction indicated by the arrows in FIG. 7. This action will tear perforated lines 200*a* and 200*b* and separate the unit into individual half-cartons. When separated, extension tab 30*a* is attached to side wall 35*b*, and extension tab 30*b* is attached to side wall 35*a*. Thus each extension tab remains on the opposite half-carton from which it originated.

It will be apparent that minor modifications to the manner in which the half-cartons are fabricated, temporarily closed, opened for tax stamping, closed for shipment to retailers, or separated into half-cartons for sale to consumers, may be made. For example, the half-carton fabrication process may include two identical machines that make half-cartons from blanks configured to produce pairs of half-cartons with the interior walls facing each other for attachment. This would alleviate the need to rotate one half-carton 180° prior to attachment.

The top closures need not be tucked into the half-cartons after tax stamping. Instead, they may be tucked into the space between interior walls 55*a* and 55*b* such that tuck portion 5*a* is glued, taped or otherwise secured to interior wall 55*a*, and tuck portion 5*b* is glued, taped or otherwise secured to interior wall 55*b*.

In addition, the shape and size of the extension tabs may be modified. The extension tab may be located on the opposite side wall (i.e., attached to side wall 30). Or both extension tabs may be located on one half-carton, on each of its two side walls.

Alternately, the size and shape of the dust flaps and insert side walls may be changed, or either or both may be eliminated.

Finally, sticky glue points, tape or other adhesive may be added to the interior walls of the half-cartons, or across the centerline of the two half-cartons to provide greater adhesion of the double half-carton unit during tax stamping.

For purposes of clarity, terms used in this specification and in the following claims, such as top, bottom, interior, exterior and side, are used solely to provide the reader with a reference for relative positions of the various half-carton walls and in no way limit the use of the invention nor the scope of the claims. For example, the "bottom wall" of the half-carton need not be used as the bottom of the box.

One skilled in the art will appreciate that the present invention can be practiced by other than the described embodiments, which are presented for purposes of illustration and not of limitation, and the present invention is limited only by the claims that follow.

I claim:

1. A detachable double half-carton for packaging a plurality of cigarette packs comprising two substantially identical half-cartons, each comprising:

an interior wall having a free edge at one edge of the interior wall;

an exterior wall, parallel to, remote from, and substantially the same size as the exterior wall;

a bottom wall, perpendicularly connected to the exterior wall and to an edge of the interior wall opposite and remote from the free edge of the interior wall;

a top closure pivotally attached to the top of the exterior wall such that the top closure may enclose the cigarette packs within the half-carton, and so that the plane defined by the free edge of the interior wall and the line along which the exterior wall and the top closure are pivotally attached is perpendicular to each of the interior and exterior walls;

a first side wall, perpendicularly connected to the exterior, interior and bottom walls; and a second side wall, parallel to, remote from, and substantially the same size as the first side wall, and further comprising a detachable extension tab extending along the plane defined by the second side wall and detachably attached to the second side wall at the edge adjacent to the interior wall;

and wherein the two half-cartons are positioned such that:

the interior walls of the two half-cartons abut each other;

the top closures of the two half-cartons are remote from each other; and the second side wall of each half-carton is adjacent to the first side wall of the other half-carton, and each detachable extension tab of each half-carton is secured to first side wall of the other half-carton.

2. The detachable double half-carton according to claim 1 wherein each of the half-cartons is formed from paperboard.

3. The detachable double half-carton according to claim 2 wherein each of the top closures further comprises:

a top portion pivotally attached to the top of the exterior wall and of a size substantially the same as that of the bottom wall; and a tuck portion pivotally attached to the side of the top portion opposite from the exterior wall;

wherein each top closure is capable of being positioned in:

(a) a first position in which the top and tuck portions are folded back along the outside of the exterior wall to which the top closure is attached, exposing the top area of the cigarette packs enclosed by the half-carton;

(b) a second position in which the top closure of one half-carton is extended across the top of both the half-cartons, and the top closure of the other half-carton is extended across the top of the first extended top closure; and (c) a third position in which the top portion of each top closure is extended across the top of the half-carton to which it is pivotally attached, and each adjoining tuck portion is inserted into the interior of the half-carton to which it is attached along the top of the interior wall.

4. The detachable double half-carton according to claim 2 wherein each of the detachable extension tabs is perforated along a line along which the extension tab intersects the plane defined by the abutted interior walls.

5. The detachable double half-carton according to claim 4 wherein each of the detachable extension tabs is affixed to the first side wall of the other half-carton with glue.

6. The detachable double half-carton according to claim 4 wherein each of the detachable extension tabs is semi-circular and has a radius of curvature less than the width of the half-carton such that when secured to the first side wall of the other half-carton, the extension tab extends less than fully across the first side wall in any direction.

7. The detachable double half-carton according to claim 6 wherein each of the half-cartons contains five cigarette packs aligned side-by-side.

8. The detachable double half-carton according to claim 7 wherein the five cigarette packs enclosed in one of the half-cartons are positioned such that at least one of a logo, a brand name and other markings on the cigarette packs are inverted relative the orientation of the five cigarette packs that are enclosed in the adjoining half-carton.

9. The detachable double half-carton according to claim 8 wherein each of the top closures further comprises:

a top portion pivotally attached to the top of the exterior wall and of a size substantially the same as that of the bottom wall; and a tuck portion pivotally attached to the side of the top portion opposite from the exterior wall;

wherein each top closure is capable of being positioned in (a) a first position in which the top and tuck portions ar folded back along the outside of the exterior wall to which the top closure is attached, exposing the top area of the cigarette packs enclosed by the half-carton;

(b) a second position in which the top closure of one half-carton is extended across the top of both the half-cartons, and the top closure of the other half-carton is extended across the top of the first extended top closure; and (c) a third position in which the top portion of each top closure is extended across the top of the half-carton to which it is pivotally attached, and each adjoining tuck portion being inserted into the interior of the half-carton to which it is attached along the top of the interior wall.

10. The detachable double half-carton according to claim 9 wherein each of the first and second side walls are pivotally attached to the exterior wall, such that the folded edges of each of the first side walls and each of the second side walls are foldably attached to the exterior walls.

11. A half-carton for enclosing a plurality of cigarette packs, the half-carton comprising a plurality of walls and further comprising:

a first wall;

a second wall perpendicularly attached to the first wall;

a third wall connected to the first wall, parallel to and remote from the second wall and having a free edge that is perpendicular to the first wall;

a detachable extension tab that extends out from and in the same plane as the first wall in the direction perpendicular to and away from the second wall; and a top closure pivotally attached to the second wall such that the plane defined by the line along which the top closure is pivotally attached to the second wall and the free edge of the third wall is perpendicular to each of the first, second and third walls;

wherein two substantially identical half-cartons may be detachably attached by affixing the detachable extension tab of each half-carton to the other half-carton such that the second wall of each half-carton is parallel to and remote from the second wall of the other half-carton.

12. The half-carton according to claim 11 wherein the half-carton is formed from paperboard.

13. The half-carton according to claim 12 wherein the top closure further comprises:

a top portion pivotally attached to the top of the second wall; and a tuck portion pivotally attached to the side of the top portion opposite from the second wall;

wherein the top closure is capable of being positioned in (a) a first position in which the top and tuck portions are folded back along the outside of the second wall, exposing the top area of the enclosed cigarette packs, (b) a second position in which the top portion is folded over and encloses the top area of the cigarette packs, and in which the tuck portion is folded over and affixed to the third wall, and (c) a third position in which the top portion is folded over and encloses the top area of the cigarette packs, and in which the tuck portion is folded over and tucked into the half-carton between the third wall and the side of the cigarette packs closest to the third wall.

14. The half-carton according to claim 12 wherein the detachable extension tab is perforated between the detachable extension tab and the first wall.

15. The half-carton according to claim 14 wherein the detachable extension tab is affixed to other the half-carton with glue.

16. The half-carton according to claim 14 wherein the detachable extension tab is semi-circular and has a radius of curvature less than the width of the first wall.

17. The half-carton according to claim 16 wherein the half-carton contains five cigarette packs aligned side-by-side.

18. The half-carton according to claim 17 wherein the five cigarette packs are positioned such that at least one of a logo, a brand name and other markings on each of the five cigarette packs are readable when the top closure is folded back along the second wall and is remote from the point of viewing, whereby a consumer can read the markings in proper orientation upon opening the top closure by pivoting the top closure away from the consumer.

19. The half-carton according to claim 18 wherein the top closure further comprises:

a portion pivotally attached to the top of the second wall; and a tuck portion pivotally attached to the side of the top portion opposite from the second wall;

wherein the top closure is capable of being positioned in (a) a first position in which the top and tuck portions are folded back along the outside of the second wall, exposing the top area of the cigarette packs enclosed by the half-carton, (b) a second position in which the top portion is folded over and encloses the top area of the cigarette packs, and in which the tuck portion is folded over and affixed to the third wall, and (c) a third position in which the top portion is folded over and encloses the top area of the cigarette packs, and in which the tuck portion is folded over and tucked into the half-carton between the third wall and the side of the cigarette packs closest to the third wall.

20. The half-carton according to claim 19 wherein a fourth wall of the plurality of walls is pivotally attached to the second wall and perpendicular to the second and third walls.

21. A foldable blank for forming a half-carton for enclosing a plurality of cigarette packs comprising:

an interior panel having a free edge;

a bottom panel foldably attached to the interior panel opposite the free edge of the interior panel;

an exterior panel foldably attached to the bottom panel and opposite from the interior panel;

a first side panel foldably attached to the exterior panel along an edge perpendicular to the bottom panel;

a second side panel foldably attached to the exterior panel opposite from the first side panel and further comprising an extension tab detachably connected to the edge of the second side panel opposite from the exterior panel; and a top closure foldably attached to the exterior panel opposite the bottom panel;

wherein the shortest distance between the free edge of the interior panel and the line along which the interior and bottom panels are pivotally attached is substantially the same as the shortest distance between the line along which the bottom and exterior panels are foldably attached and the line along which the exterior panel and top closure are foldably attached;

whereby when the blank is folded and formed into a half-carton, the half-carton may be detachably attached to a second identically formed half-carton by abutting the interior panel of each half-carton against the interior panel of the other half-carton and securing the extension tab of each half-carton to the first side panel of the other half-carton.

22. The blank according to claim 21 wherein the blank is made of paperboard.

23. The blank according to claim 22 wherein the top closure further comprises:

a top portion foldably attached to the exterior panel opposite from the bottom panel and of substantially the same size as the bottom panel; and a tuck portion foldably attached to the top portion opposite from the exterior panel.

24. The blank according to claim 23 further comprising two foldable box insert side panels at opposite ends of the interior panel.

25. The blank according to claim 24 further comprising two foldable dust flaps at opposite ends of the bottom panel and adjacent to the box insert side panels.

* * * * *